US011826879B2

(12) United States Patent
Takeda

(10) Patent No.: US 11,826,879 B2
(45) Date of Patent: Nov. 28, 2023

(54) CUTTING MACHINE

(71) Applicant: DISCO CORPORATION, Tokyo (JP)

(72) Inventor: Shun Takeda, Tokyo (JP)

(73) Assignee: DISCO CORPORATION, Tokyo (JP)

( * ) Notice: Subject to any disclaimer, the term of this patent is extended or adjusted under 35 U.S.C. 154(b) by 435 days.

(21) Appl. No.: 17/342,736

(22) Filed: Jun. 9, 2021

(65) Prior Publication Data

US 2021/0402560 A1 Dec. 30, 2021

(30) Foreign Application Priority Data

Jun. 24, 2020 (JP) ..... 2020-108765

(51) Int. Cl.

| | |
|---|---|
| ***B24B 49/12*** | (2006.01) |
| ***B24B 49/00*** | (2012.01) |
| ***B24B 7/16*** | (2006.01) |
| ***B26D 7/01*** | (2006.01) |

(52) U.S. Cl.

CPC ..... *B24B 49/12* (2013.01); *B24B 7/16* (2013.01); *B24B 49/003* (2013.01); *B26D 7/01* (2013.01)

(58) Field of Classification Search

CPC ..... B24B 49/12; B24B 7/16; B24B 49/003; B24B 7/228; B24B 27/0658; B24B 41/00; B24B 41/005; B24B 41/002; B24B 41/04; B24B 41/042; B24B 47/20–22; B24B 51/00; B26D 7/01; B28D 5/023; B28D 5/0058; B28D 5/0094; G01B 11/00; G01B 17/00; G01B 11/02; G01B 11/28; Y10T 83/7697–7726; Y10T 83/05; B23Q 15/12–16; B23Q 15/26

See application file for complete search history.

(56) References Cited

FOREIGN PATENT DOCUMENTS

| | | | | |
|---|---|---|---|---|
| CN | 101318358 A | * | 12/2008 | ..... B28D 5/02 |
| JP | 2011011299 A | | 1/2011 | |
| JP | 2011224666 A | | 11/2011 | |
| JP | 2011255458 A | | 12/2011 | |
| JP | 2012223848 A | | 11/2012 | |
| JP | 2017221994 A | | 12/2017 | |
| JP | 2018187694 A | | 11/2018 | |
| JP | 6689534 B2 | * | 4/2020 | ..... B24B 45/00 |

* cited by examiner

*Primary Examiner* — Laura C Guidotti
*Assistant Examiner* — John C Merino
(74) *Attorney, Agent, or Firm* — Greer Burns & Crain Ltd.

(57) ABSTRACT

There is provided a cutting machine for cutting a wafer using a cutting blade. The cutting machine includes a shape storage section, a shape measurement unit, a determination section, and an end face correction device. The shape storage section stores a cross-sectional shape of a support surface, which a mount of a cutting unit has, in an axial direction of a spindle. The shape measurement unit contactlessly measures the cross-sectional shape of the support surface in the axial direction of the spindle. Through a comparison between the cross-sectional shape stored in the shape storage section and the cross-sectional shape measured by the shape measurement unit, the determination section determines whether or not the support surface needs a correction. The end face correction device corrects a shape of the support surface.

3 Claims, 7 Drawing Sheets

CUTTING MACHINE

BACKGROUND OF THE INVENTION

Field of the Invention

The present invention relates to a cutting machine for cutting a workpiece using a cutting blade.

Description of the Related Art

A cutting machine that cuts a workpiece, which is held on a holding surface of a holding table, using a cutting blade cuts the workpiece by rotating the cutting blade and moving the workpiece in a cutting direction of the cutting blade.

Cutting blades include blades of a shape similar to an annular or disc-shaped washer, and hub blades with abrasive stones bonded on an aluminum hub by electroforming. Each cutting blade is held and fixed between a mount, which is fixed on a distal end of a spindle and includes an external thread, and a nut maintained in threaded engagement with the external thread of the mount.

If an annular or disc-shaped cutting blade is fixed on a mount, the mount is therefore damaged at its support surface in contact with the cutting blade, so that the support surface becomes no longer flat. If a cutting blade of the type that abrasive stones are bonded in an annular pattern on an outer periphery of an aluminum hub by electroforming is fixed on a mount, on the other hand, aluminum deposits on a support surface of the mount, the support surface being in contact with the aluminum hub, so that the support surface no longer has a desired shape. If a support surface of a mount, with which a cutting blade is to be brought into contact, no longer has a desired shape as described above, the cutting blade fitted on the mount rotates while wobbling in a thickness direction, thereby raising a problem that a workpiece is formed with wider kerfs.

To avoid the occurrence of such a problem, the support surface of a mount, with which a cutting blade is to be brought into contact, is therefore ground by a grinding stone to correct its shape as disclosed in JP 2011-224666A, JP 2011-011299A, JP 2011-255458A, JP 2012-223848A, and JP 2018-187694A. As disclosed in JP 2017-221994A, it has also been proposed to detach a cutting blade from a mount and after performing a correction of the shape of the support surface, to confirm whether or not the shape of the support surface has been appropriately corrected.

SUMMARY OF THE INVENTION

However, the method disclosed in JP 2017-221994A has a potential risk of damaging the support surface because the determination is made by bringing a jig into contact the support surface with which the cutting blade is to be brought into contact.

The present invention therefore has as an object thereof the provision of a cutting machine that can perform, without bringing a jig into contact with a support surface, confirmation of whether or not the support surface needs a correction and inspection of whether or not the correction has been appropriately performed.

In accordance with an aspect of the present invention, there is provided a cutting machine for cutting a wafer using a cutting blade. The cutting machine includes a holding table that holds the wafer on a holding surface thereof, a cutting unit including a mount having an external thread formed on a distal end of a cylinder, the external thread being disposed on a distal end of a spindle and extending in an axial direction of the spindle, and a support surface that is formed in an annular shape concentric with the external thread and supports the cutting blade thereon, and a nut that is brought into threaded engagement with the external thread to hold the cutting blade between the nut and the support surface, whereby the wafer held on the holding surface is cut by the cutting blade, a shape storage section that stores a cross-sectional shape of the support surface in the axial direction of the spindle, a shape measurement unit that contactlessly measures the cross-sectional shape of the support surface in the axial direction of the spindle, a determination section that through a comparison between the cross-sectional shape stored in the shape storage section and the cross-sectional shape measured by the shape measurement unit, determines whether or not the support surface needs a correction, and an end face correction device that corrects a shape of the support surface. The end face correction device includes a correction grinding stone arranged such that the correction grinding stone is able to be brought into contact with the support surface, an end detection section that detects an end of the correction grinding stone, and a movement control section configured to move the correction grinding stone and the support surface relative to each other in a direction parallel to the support surface with the end of the correction grinding stone maintained in contact with the support surface.

Preferably, the shape measurement unit may include an emitter unit that emits a laser beam toward the support surface in the axial direction of the spindle, and an image sensor that receives reflected light of the laser beam reflected on the support surface. The shape measurement unit may measure a distance from the emitter unit to the support surface in the axial direction of the spindle based on a light reception position at which the image sensor has received the reflected light.

Also, preferably, the shape measurement unit may include a transmitter unit that transmits ultrasonic vibrations toward the support surface in the axial direction of the spindle, and a receiver unit that receives vibrations generated by reflection of the ultrasonic vibrations on the support surface, the ultrasonic vibrations being transmitted by the transmitter unit. The shape measurement unit may measure a distance from the transmitter unit to the support surface in the axial direction of the spindle based on a time from the transmission of the ultrasonic vibrations by the transmitter unit until the reception by the receiver unit of the vibrations reflected on the support surface.

The cutting machine according to the aspect of the present invention can contactlessly determine whether or not the shape of the support surface of the mount needs a correction, and if needs can correct the shape of the support surface. Accordingly, it is possible to correct the support surface into a desired shape without damage to the support surface, and to prevent widening of kerfs in a workpiece.

The above and other objects, features and advantages of the present invention and the manner of realizing them will become more apparent, and the invention itself will best be understood from a study of the following description and appended claims with reference to the attached drawings showing preferred embodiments of the invention.

DETAILED DESCRIPTION OF THE PREFERRED EMBODIMENTS

With reference to the attached drawings, a description will hereinafter be made regarding embodiments of the present invention.

1. First Embodiment (1) Cutting Machine

Figure 1:
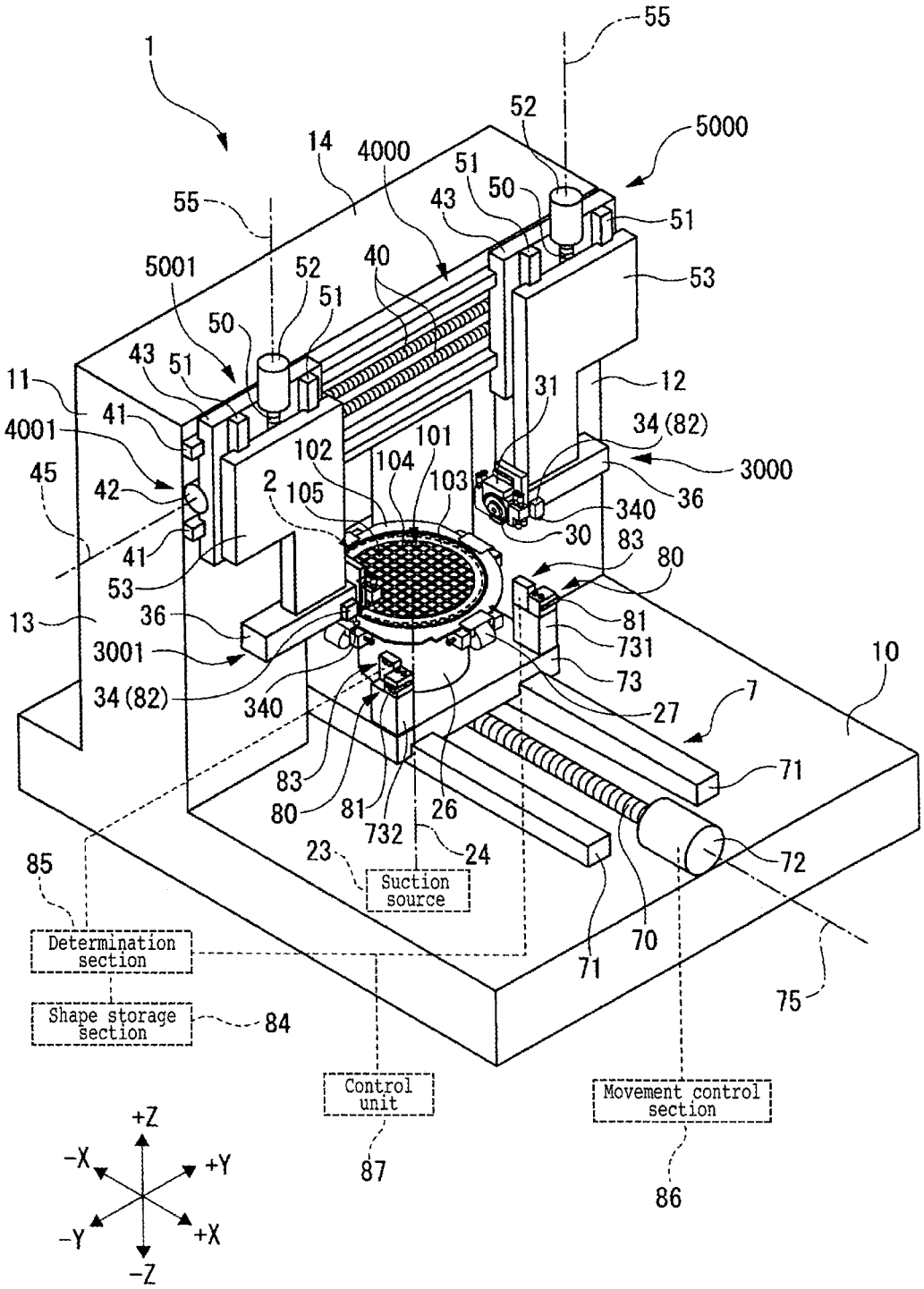
FIG. 1 is a perspective view depicting a cutting machine according to a first embodiment of the present invention.

A cutting machine 1 depicted in FIG. 1 performs cutting processing of a workpiece 101, which is held on a holding surface as an upper surface of a holding table (holding means) 2, using a first cutting unit (first cutting means) 3000 and a second cutting unit (second cutting means) 3001. The workpiece 101 is, for example, a disc-shaped semiconductor wafer or the like. On an upper surface of the workpiece 101, a plurality of intersecting dicing lines (hereinafter called "streets") 104 is formed, and devices 105 are arranged in individual regions defined by the streets 104.

The cutting machine 1 includes a base 10 having a parallelepipedal shape.

On the base 10, an X-axis moving mechanism (X-axis moving means) 7 is arranged to move the holding table 2 in an X-axis direction. The X-axis moving mechanism 7 includes a ball screw 70 having a rotation axis 75 in the X-axis direction, an X-axis motor 72 that rotates the ball screw 70 about the rotation axis 75, a pair of guide rails 71 arranged in parallel with the ball screw 70, and a movable plate 73 provided on a lower surface thereof with nuts, which are maintained in threaded engagement with the ball screw 70, and movable along the guide rails 71 in the X-axis direction.

On an upper surface of the movable plate 73, a casing 26 having a cylindrical shape is arranged, and inside the casing 26, an undepicted rotation mechanism (rotation means) or the like is arranged, for example. In FIG. 1, a configuration is depicted with the holding table 2 arranged above the casing 26.

By driving the ball screw 70 with the X-axis motor 72 and rotating the ball screw 70 about the rotation axis 75, the movable plate 73 is moved in the X-axis direction while being guided by the guide rails 71, and at the same time the holding table 2 supported on the movable plate 73 is moved in the X-axis direction. The holding table 2 is rotatable about a rotation axis 24, for example, by the undepicted rotation mechanism or the like. The holding surface of the holding table 2 is in communication with a suction source 23. Around the holding surface of the holding table 2, a plurality (four in FIG. 1) of clamps 27 is arranged.

In the workpiece 101 held on the holding table 2, the workpiece 101 is surrounded by an annular frame 102, and together with the frame 102, the workpiece 101 is bonded on a side of a lower surface thereof to a tape 103. The workpiece 101 is therefore supported by the frame 102 via the tape 103.

On a −X side of the base 10, a gate-type column 11 is arranged. The gate-type column 11 includes a first column portion 12 and a second column portion 13, which are disposed upright on opposite sides of a moving path of the holding table 2 detachably arranged on the base 10 via the X-axis moving mechanism 7, and a beam section 14 disposed extending in a Y-axis direction between upper parts of the first column portion 12 and the second column portion 13.

On a +X side, front wall of the first column portion 12, a first Y-axis moving mechanism (first Y-axis moving means) 4000 is arranged to move the first cutting unit 3000 in the Y-axis direction, and on a +X side, front wall of the second column portion 13, a second Y-axis moving mechanism (second Y-axis moving means) 4001 is arranged to move the second cutting unit 3001 in the Y-axis direction.

The first Y-axis moving mechanism 4000 includes a ball screw 40 having a rotation axis 45 in the Y-axis direction, a pair of guide rails 41 arranged in parallel with the ball screw 40, a Y-axis motor 42 connected to one end of the ball screw 40, and a moving base 43 provided on a −X side, rear surface thereof with nuts, which are maintained in threaded engagement with the ball screw 40, and maintained at the rear surface thereof in sliding contact with the guide rails 41.

On the moving base 43, a first Z-axis moving mechanism (first Z-axis moving means) 5000 is arranged to move the first cutting unit 3000 in a Z-axis direction such that the moving base 43 supports the first cutting unit 3000 via the first Z-axis moving mechanism 5000.

By driving the ball screw 40 using the Y-axis motor 42 and rotating the ball screw 40 about the rotation axis 45, the moving base 43 is moved in the Y-axis direction while being guided by the guide rails 41, and the first Z-axis moving mechanism 5000 and the first cutting unit 3000 are also moved in the Y-axis direction.

The second Y-axis moving mechanism 4001 has a similar configuration as the first Y-axis moving mechanism 4000, and therefore its constituents are identified by like reference symbols and their description is omitted.

The first Z-axis moving mechanism 5000 includes a ball screw 50 having a rotation axis 55 in the Z-axis direction, a pair of guide rails 51 arranged in parallel with the ball screw 50, a Z-axis motor 52 connected to one end of the ball screw 50 to rotate the ball screw 50 about the rotation axis 55, and an up-and-down plate 53 provided on a −X side, rear surface thereof with nuts, which are maintained in threaded engagement with the ball screw 50, and maintained at the rear surface thereof in sliding contact with the guide rails 51. The up-and-down plate 53 supports the first cutting unit 3000.

When the ball screw 50 is driven using the Z-axis motor 52, the ball screw 50 rotates about the rotation axis 55. Accompanied by the rotation of the ball screw 50, the up-and-down plate 53 moves in the Z-axis direction while being guided by the guide rails 51, and the first cutting unit 3000 moves up or down in the Z-axis direction.

A second Z-axis moving mechanism (second Z-axis moving means) 5001 has a similar configuration as the first Z-axis moving mechanism 5000, and therefore its constituents are identified by like reference symbols and their description is omitted.

The X-axis moving mechanism 7, the first Y-axis moving mechanism 4000 and the second Y-axis moving mechanism 4001, and the first Z-axis moving mechanism 5000 and second Z-axis moving mechanism 5001 are controlled by a control unit 87.

The first cutting unit 3000 includes a blade cover 31 that covers from above a cutting blade 30 installed on the first cutting unit 3000.

On a +X side of the cutting blade 30, a cutting water nozzle is arranged to supply cutting water toward the cutting blade 30 from a side of an outer periphery of the cutting blade 30.

The second cutting unit 3001 has a similar configuration as the first cutting unit 3000, and therefore its constituents are identified by like reference symbols and their description is omitted.

At positions adjacent the first cutting unit 3000 and the second cutting unit 3001, alignment units (alignment means) 34 are arranged to detect the streets 104 along which the workpiece 101 is to be cut. Each alignment unit 34 has a camera 340 or the like. With the workpiece 101 positioned underneath the alignment unit 34, for example, the street 104 formed on the workpiece 101 is imaged using the camera 340, whereby based the image so captured, the street 104 can be detected.

The first cutting unit 3000 and the second cutting unit 3001 each include a housing 36, in which an undepicted motor or the like is accommodated.

Figure 2:
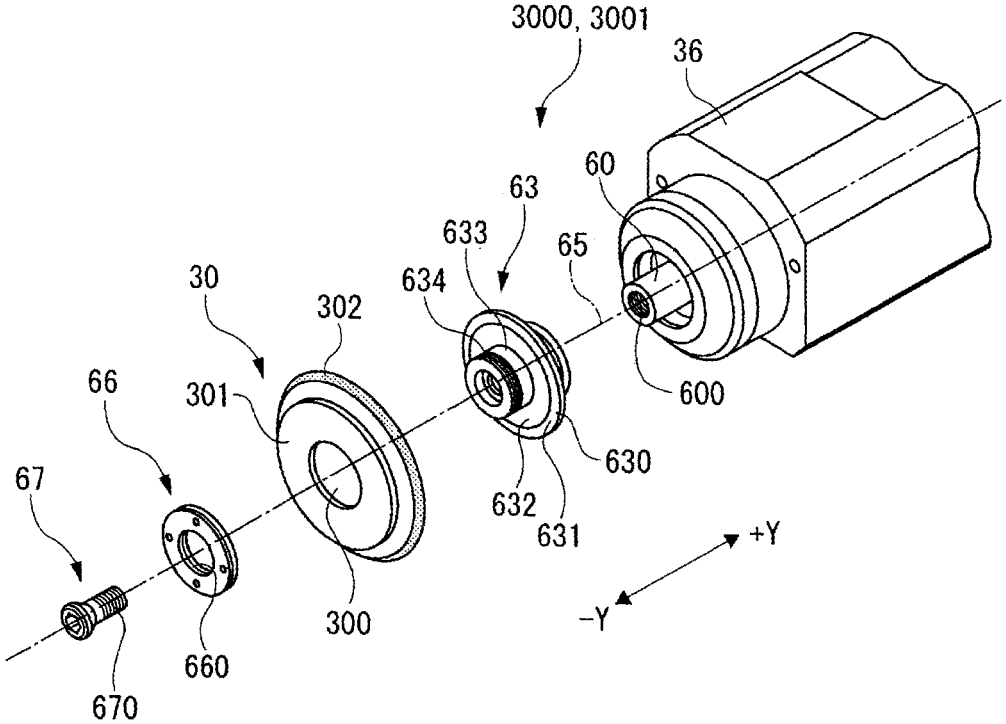
FIG. 2 is an exploded perspective view depicting an example of a cutting unit.

The first cutting unit 3000 and the second cutting unit 3001 each include, as depicted in FIG. 2, a spindle 60, a mount 63 fixed on a distal end of the spindle 60, a nut 66 that presses the cutting blade 30, which is to be fitted on the mount 63, toward the mount 63, and a lock bolt 67.

The spindle 60 is formed, for example, in a cylindrical shape. The spindle 60 is accommodated in the housing 36. The spindle 60 is connected to an undepicted motor that rotates the spindle 60 about a rotation axis 65 in the Y-axis direction. An internal thread 600 is formed on the distal end of the spindle 60.

The cutting blade 30 includes an aluminum-made, annular hub 301 having an opening 300 in a center thereof, and a cutting edge 302 arranged on an outer periphery of the annular hub 301. The cutting edge 302 is bonded on an outer peripheral portion of the annular hub 301 by electroforming.

The mount 63 includes a disc-shaped flange portion 630, and a cylindrical boss portion 633 formed centrally of the flange portion 630 and protruding in the direction of the rotation axis 65 of the spindle 60 (in a −Y direction).

The flange portion 630 has an annular support surface 631 that supports the cutting blade 30 on a +Y side thereof. The flange portion 630 also has a recessed portion 632 recessed in a +Y direction from the support surface 631 on a radially inner side of the support surface 631.

On a distal end of an outer surface of the boss portion 633, an external thread 634 is formed, and the support surface 631 is formed in an annular shape that is concentric with the external thread 634.

On an inner surface of the nut 66, an internal thread 660 is formed corresponding to the external thread 634 of the mount 63. On the lock bolt 67, an external thread 670 is formed corresponding to the internal thread 600 of the spindle 60.

By fitting the opening 300 of the cutting blade 30 on the boss portion 633 of the mount 63, bringing the cutting blade 30 into contact at one side thereof with the support surface 631 of the mount 63, and bringing the nut 66 into threaded engagement with the external thread 634 of the boss portion 633, the cutting blade 30 is held between the support surface 631 and the nut 66 and is hence fixed on the distal end of the spindle 60.

Cutting processing of the workpiece 101 depicted in FIG. 1 can be performed by bringing the rotating cutting edge 302 into cutting engagement with the workpiece 101 while driving and rotating the cutting edge 302, for example, with the undepicted motor or the like accommodated inside the housing 36.

As depicted in FIG. 1, a first base 731 and a second base 732 are arranged on the movable plate 73. On the first base 731 and second base 732, end face correction devices (end face correction means) 80 are arranged to correct cross-sectional shapes in the Y-axis direction of the support surfaces 631 of the respective mounts 63 included in the first cutting unit 3000 and second cutting unit 3001.

The end face correction devices 80 include correction grinding stones 81, respectively, which are each formed in a flat plate shape extending in a direction of an X-Y plane. The correction grinding stones 81 stick out from a side surface in the +Y direction of the first base 731 and a side surface in the −Y direction of the second base 732, respectively, toward sides closer to the corresponding mounts 63.

The end face correction devices 80 also include end detection sections 82, respectively, to detect ends of the corresponding correction grinding stones 81. In the first embodiment of FIG. 1, the alignment units 34 also act as the end detection sections 82, although end detection sections may be included separately from the alignment units 34.

Each end face correction device 80 also includes a movement control section 86 to move the correction grinding stone 81 and the support surface 631 relative to each other in the X-axis direction parallel to the support surface 631 with the support surface 631 and the end of the correction grinding stone 81 being maintained in contact with each other. In the first embodiment of FIG. 1, control of the X-axis moving mechanism 7 by the movement control section 86 enables to move the correction grinding stone 81 and the support surface 631 relative to each other in the direction parallel to the support surface 631.

Figure 3:
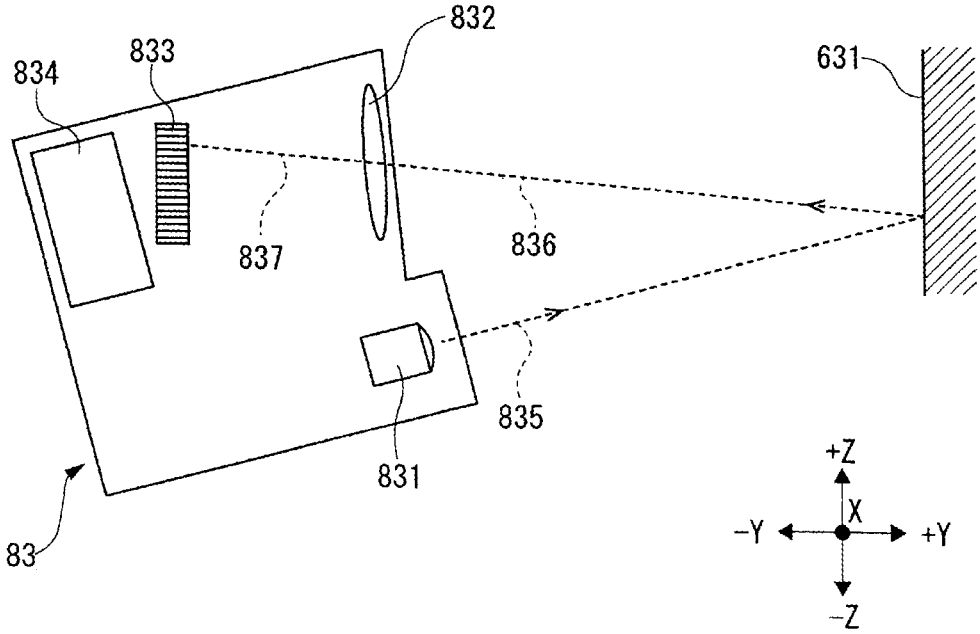
FIG. 3 is a schematic diagram illustrating a first example of a shape measurement unit.

At a −X side, adjacent position of each end face correction device 80, a shape measurement unit (shape measurement means) 83 is arranged. As illustrated in FIG. 3, the shape measurement unit 83 includes an emitter unit (laser oscillator) 831 that emits a laser beam 835 in the direction of the rotation axis 65 of the spindle 60 (the Y-axis direction) to the support surface 631 of the mount 63 included in the corresponding first cutting unit 3000 or second cutting unit 3001, a lens 832 that focuses reflected light 836 of the laser beam 835 reflected on the support surface 631, an image sensor 833 that receives the reflected light 837 so focused, and a calculation unit 834 that calculates a distance from the emitter unit 831 to the support surface 613 and based on the calculated value, determines the cross-sectional shape of the support surface 631.

The lens 832 and the image sensor 833 are arranged at positions offset from the emitter unit 831 in the X-axis direction or Z-axis direction. FIG. 3 illustrates the shape measurement unit 83 on the first base 731, and the lens 832 and the image sensor 833 are located, for example, on a −X side of the emitter unit 831. On the other hand, the lens 832 and the image sensor 833 in the shape measurement unit 83 on the second base 732 are arranged, for example, on a +X side of the emitter unit 831 although not illustrated in the figure.

The image sensor 833 is configured with a plurality of light-receiving portions, which receive the reflected light 837 focused through the lens 832, being arranged in arrays in the X-axis directions. Relying upon which light receiving portions of the image sensor 833 have received the reflected light 837, the calculation unit 834 calculates the distance from the emitter unit 831 to the support surface 631. By successively performing such a distance calculation while moving the image sensor 833 and the support surface 613 relative to each other in the X-axis direction or Z-axis direction, the cross-sectional shape of the support surface 631 in the direction of the rotation axis 65 of the spindle 60 (the Y-axis direction) is acquired.

The cutting machine 1 also includes a shape storage section 84 and a determination section 85. The shape storage section 84 stores the cross-sectional shape of the support surface 631 in the direction of the rotation axis 65 of the spindle 60 (the Y-axis direction) as a stored cross-sectional shape beforehand. Through a comparison between the stored cross-sectional shape stored in the shape storage section 84 and the measured cross-sectional shape measured as an actual cross-sectional shape by the shape measurement unit 83, the determination section 85 determines whether or not the shape of the support surface 631 needs a correction.

Figure 4:
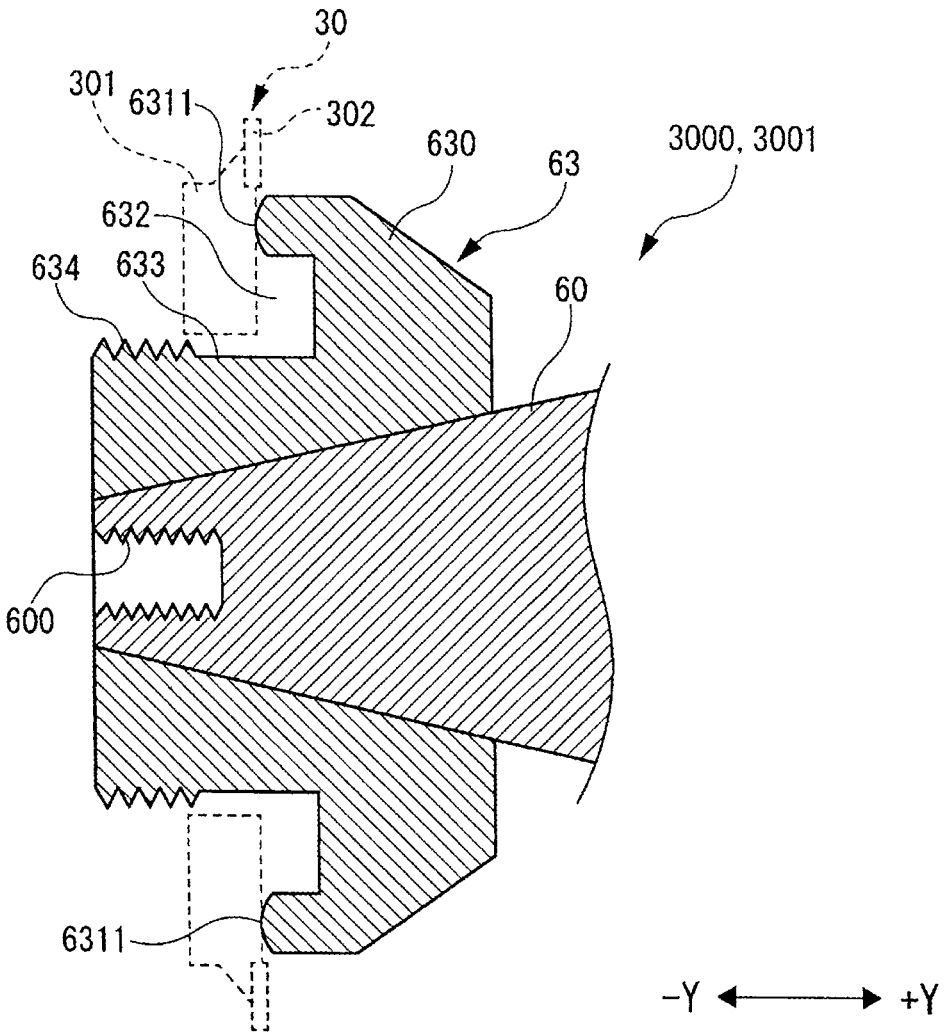
FIG. 4 is a cross-sectional view depicting a first example of a cross-sectional shape of a support surface.

If the cutting blade 30 installed on each of the first cutting unit 3000 and the second cutting unit 3001 is a hub blade 30 depicted in FIG. 4, a support surface 6311 depicted in FIG. 4 is formed in an arc shape in cross-section, the position of which in the Y-axis direction differs according to the position in the radial direction of the mount 63 on which the support surface 6311 is formed.

Figure 5:
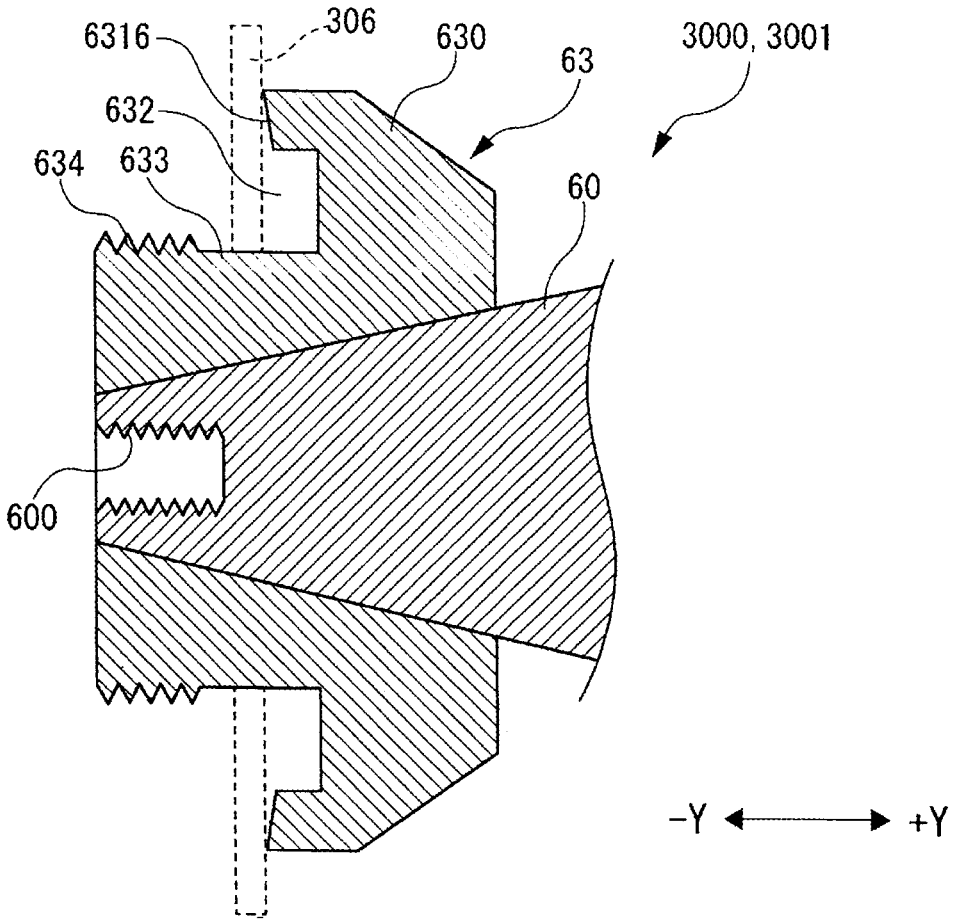
FIG. 5 is a cross-sectional view depicting a second example of the cross-sectional shape of the support surface.

If the cutting blade 30 installed on each of the first cutting unit 3000 and the second cutting unit 3001 is a washer-type hubless blade 306 depicted in FIG. 5 and having no circular hub, on the other hand, a support surface 6316 is formed in a flared shape in cross-section that toward a radially outer side of the mount 63, the support surface 6316 protrudes more in the −Y direction and becomes closer to the hubless blade 306.

In the shape storage section 84, one of the arc shape in cross-section and the flared shape in cross-section is stored beforehand depending on whether the cutting blade to be fitted on the mount 63 is the hub blade 30 or the hubless blade 306. In the case of the arc shape in cross-section, for example, values such as the distance in the Y-axis direction between a portion protruding most in the −Y direction (ridge portion) and a portion located most apart in the +Y direction from hub blade 30 (an outermost peripheral portion or an innermost peripheral portion), the distance in the radial direction between the outermost peripheral portion and the innermost peripheral portion (two positions located most apart in the +Y direction from the hub blade 30), and the radius of curvature of the arc, and the like are stored. In the case of the flared shape in cross-section, on the other hand, values of the distance in the Y-axis direction between an outer peripheral edge and an inner peripheral edge, and the like are stored.

As an alternative, two shapes, one being the arc shape in cross-section corresponding to the hub blade 30, and the other the flared shape in cross-section corresponding to the hubless blade 306, may be set and stored in the shape storage section 84.

(2) Correction of Shape of Support Surface

When desired to replace the cutting blade 30 installed on the first cutting unit 3000 or the second cutting unit 3001, the nut 66 is detached from the mount 63, and the cutting blade 30 is then pulled out of the mount 63 (see FIG. 2). It is then ascertained whether or not the support surface 631 of the mount 63 has the desired shape corresponding to the type of the cutting blade 30.

Figure 6:
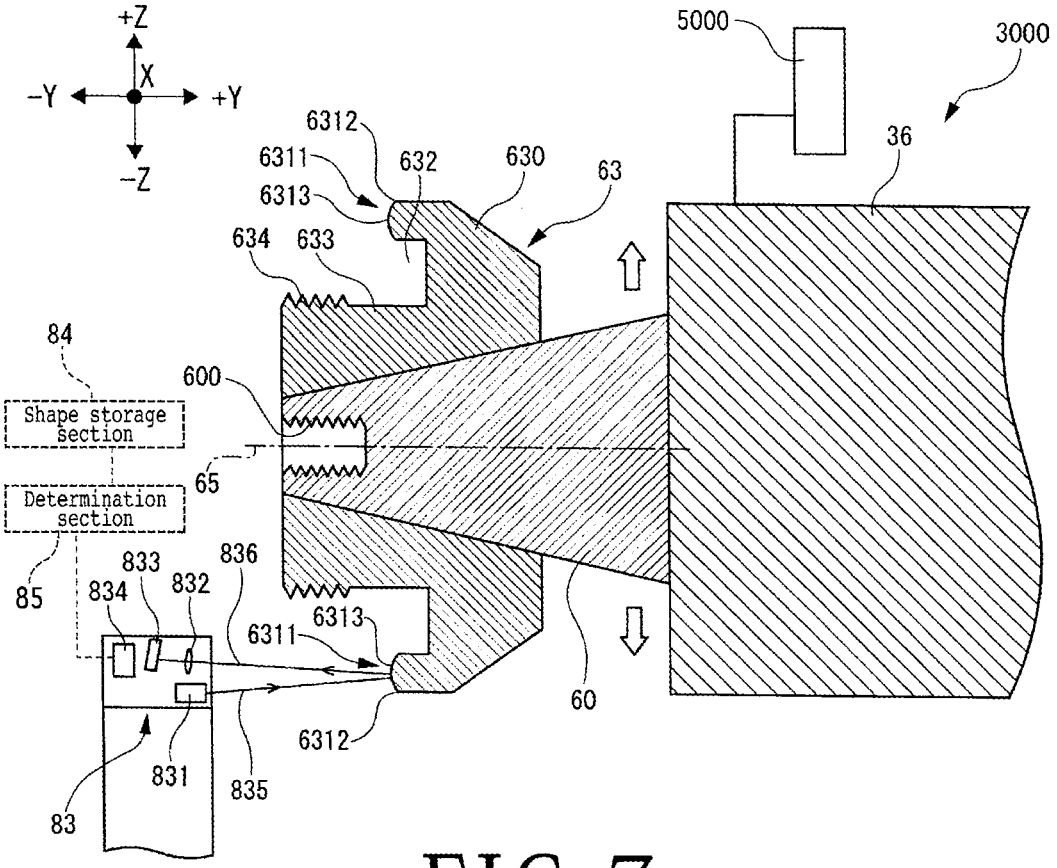
FIG. 6 is a schematic diagram illustrating how to measure the first example of the cross-sectional shape of the support surface in the cutting machine according to the first embodiment.

If there is a need to correct the shape of the support surface 631 of the mount 63 included in the first cutting unit 3000, for example, the X-axis moving mechanism 7 depicted in FIG. 1 first moves the movable plate 73 in the X-axis direction, and at the same time the first Y-axis moving mechanism 4000 and the first Z-axis moving mechanism 5000 move the first cutting unit 3000 in the Y-axis direction and Z-axis direction, respectively, whereby the support surface 6311 and the shape measurement unit 83 are positioned to face each other as illustrated in FIG. 6.

While emitting the laser beam 835 from the emitter unit 831 to the support surface 6311, the first Z-axis moving mechanism 5000 changes a height position in the Z-axis direction of the first cutting unit 3000 to scan the laser beam 835 along the support surface 6311 in the radial direction, whereby the calculation unit 834 calculates the distance between the emitter unit 831 and the support surface 6311 at every point in the radial direction of the support surface 6311. Based on data calculated by the calculation unit 834 as described above, a distribution that indicates the individual points in the Y-axis direction of the support surface 6311 is created, so that a current shape of the support surface 6311 is ascertained.

As an alternative, the shape of the support surface 6311 may be ascertained in such a manner that while emitting the laser beam 835 from the emitter unit 831 to the support surface 6311, the X-axis moving mechanism 7 moves the movable plate 73 in the X-axis direction to scan the laser beam 835 along the support surface 6311 in the radial direction, whereby the calculation unit 834 calculates the distance between the emitter unit 831 and the support surface 6311 at every point in the radial direction of the support surface 6311.

As another alternative, the shape of the support surface 6311 may be ascertained by rotating the mount 63 about the rotation axis 65.

The desired shape of the support surface 631 is stored in the shape storage section 84. Described specifically, if the cutting blade 30 is a hub blade, the arc shape in cross-section of the support surface 6311 as depicted in FIG. 4 is stored. If the cutting blade 30 is a hubless blade, on the other hand, the flared shape in cross-section of the support surface 6316 as depicted in FIG. 5 is stored.

As an alternative, the shape of the support surface as ascertained by measuring the mount fixed on the spindle as described above may be stored, or the shape of the support surface may be stored as data such as image data or numerical data.

If the hub blade 30 is fitted as a cutting blade on the mount 63, for example, the determination section 85 compares the cross-sectional arc shape stored in the shape storage section 84 and the actual shape ascertained by the shape measurement unit 83. If both the shapes are different, the end face correction device 80 corrects the shape of the support surface 6311. Specifically, the following method can be used for this correction.

First, the X-axis moving mechanism 7 depicted in FIG. 1 moves the movable plate 73 in the X-axis direction, and at the same time the first Z-axis moving mechanism 5000 progressively lowers the first cutting unit 3000, whereby the camera 340 is positioned above the correction grinding stone 81 arranged on the first base 731. The position of the first cutting unit 3000, for example, when the +Y side end of the correction grinding stone 81 is located at the center of the lens of the camera 340 is then ascertained, as the position of the +Y side end of the correction grinding stone 81, based on the number of pulse signals to the Y-axis motor 42 at that time, or the like.

Accordingly, the +Y side end of the correction grinding stone 81 can be moved to a position, at which the +Y side end of the correction grinding stone 81 comes into contact with the support surface 6311, based on the distance in the Y-axis direction between the center of the camera 340 and the support surface 6311 as stored beforehand.

Figure 7:
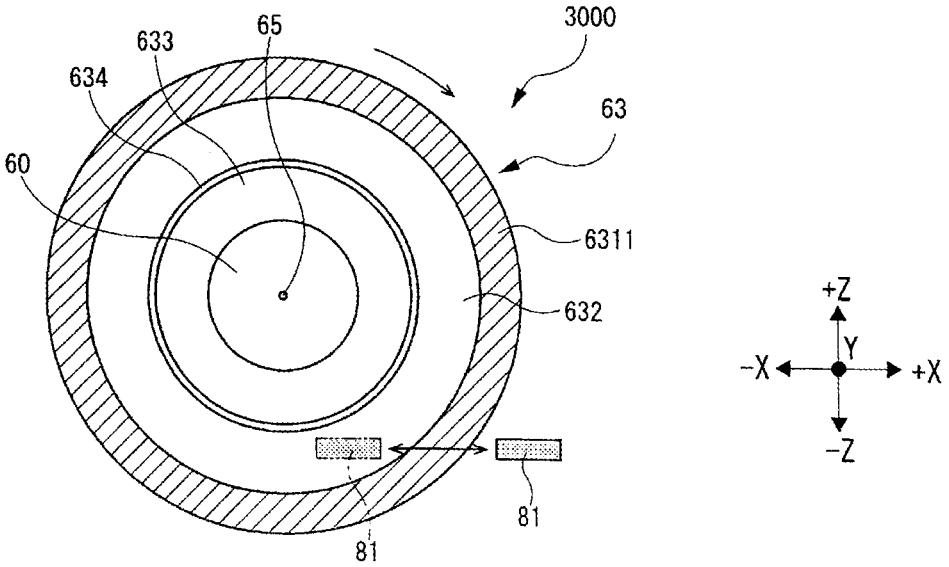
FIG. 7 is a schematic view illustrating how to correct the first example of the cross-sectional shape of the support surface in the cutting machine according to the first embodiment.

Next, the X-axis moving mechanism 7 moves the movable plate 73 in the X-axis direction, and as illustrated in FIG. 7, positions the support surface 6311 of the mount 63, for example, on a −X side of the correction grinding stone 81 included in the end face correction device 80. In the example illustrated in FIG. 7, the first Z-axis moving mechanism 5000 has moved the up-and-down plate 53 in the Z-axis direction so that the support surface 6311 is located at a lowest portion of an inner peripheral edge thereof slightly lower than the correction grinding stone 81.

The first cutting unit 3000 is next positioned at a location where the support surface 6311 of the mount 63 and the +Y side end of the correction grinding stone 81 can come to contact with each other. Here, for example, the distance between the position in the Y-axis direction of the camera 340 and the position in the Y-axis direction of the outer peripheral edge 6312 of the support surface 6311 of the mount 63, the outer peripheral edge 6312 being located most apart in the +Y direction from the hub blade 30, is available to the control unit 87 depicted in FIG. 1, and the position in the Y-axis direction of the outer peripheral edge 6312 of the support surface 6311 and the position of the +Y side end of the correction grinding stone 81 are allowed to match each other by positioning the first cutting unit 3000 at a location corresponding to a difference obtained by subtracting the above-described distance from the position of the first cutting unit 3000 when the center of the lens of the camera 340 is located at the +Y side end of the correction grinding stone 81.

With the support surface 6311 being hence set ready to be subjected to processing by the correction grinding stone 81, the spindle 60 is rotated, and at the same time the X-axis moving mechanism 7 moves the movable plate 73 first in a −X direction and then in a +X direction under control by the movement control section 86, whereby the correction grinding stone 81 is brought into contact with the support surface 6311 and the support surface 6311 is ground.

Described specifically, to correct the support surface 6311 into the desired arc shape in cross-section, the correction grinding stone 81 is moved in the −X direction so that the correction grinding stone 81 is caused to cross the support surface 6311. Next, the first Y-axis moving mechanism 4000 moves the first cutting unit 3000 in a predetermined amount in the −Y direction by index feeding. Then, the correction grinding stone 81 is moved in the +X direction so that the correction grinding stone 81 is caused to cross the support surface 6311. Next, the first Y-axis moving mechanism 4000 moves the first cutting unit 3000 in a predetermined amount in the −Y direction by index feeding. In this manner, the support surface 6311 is brought closer to the correction grinding stone 81 every time the correction grinding stone 81 is moved in the X-axis direction. The correction grinding stone 81 is worn in contact with the support surface 6311, so that the stock removal is large at the beginning of contact with the support surface 6311 and then becomes gradually smaller due to wearing of the correction grinding stone 81 as the correction grinding stone 81 crosses the support surface 6311. Using this phenomenon, the support surface 6311 is therefore formed in the arc shape in cross-section.

The correction of the support surface 6311 may be performed using a correction grinding stone 91 (see FIGS. 8 and 10) in a second embodiment to be described subsequently herein.

After correcting the shape of the support surface 6311 as described above, the shape measurement unit 83 is positioned to face the support surface 6311, and the shape of the corrected support surface 6311 is ascertained by the shape measurement unit 83. The method of this ascertainment is similar to that used before the correction of the shape of the support surface 6311. The determination section 85 then compares the measured cross-sectional shape of the support surface 6311 as ascertained by the shape measurement unit 83 and the stored cross-sectional shape stored in the shape storage section 84 and, if different, the correction of the support surface 6311 is performed again. If the measured cross-sectional shape and the stored cross-sectional shape are determined to match each other, on the other hand, the hub blade 30 is fitted as a cutting blade on the mount 63, and the nut 66 is brought into threaded engagement with the external thread 634 of the mount 63. In this state, as depicted in FIGS. 4 and 6, one side in the +Y direction of the annular hub 301 is supported over an annular area thereof, which surrounds the rotation axis 65 of the mount 63, on the ridge 6313 of the support surface 6311.

In the first embodiment described above, the description is made regarding the case in which the shape of the support surface 6311 of the mount 63 of the first cutting unit 3000 is corrected. A similar method can be applied when correcting the shape of the support surface 6311 of the mount 63 of the second cutting unit 3001.

(3) Cutting of Workpiece

When subjecting the workpiece 101 depicted in FIG. 1 to cutting processing, the workpiece 101 supported on the frame 102 via the tape 103 is first held under suction on the holding surface of the holding table 2. Using the X-axis moving mechanism 7, the holding table 2 is then moved in the X-axis direction so that the workpiece 101 held on the holding table 2 is positioned underneath the first cutting unit 3000 and the second cutting unit 3001.

Imaging or the like of the streets 104 is next performed using the cameras 340 included in the alignment units 34. Based on the captured image of the streets 104, the first cutting unit 3000 and the second cutting unit 3001 are appropriately moved in the Y-axis direction using the first Y-axis moving mechanism 4000 and the second Y-axis moving mechanism 4001, thereby performing position matching in the Y-axis direction of the first cutting unit 3000 and the second cutting unit 3001 relative to desired two of the streets 104.

Thereafter, using the undepicted motors or the like accommodated in the housings 36, the cutting blades 30 included in the first cutting unit 3000 and the second cutting unit 3001 are rotated, respectively.

Then, using the first Z-axis moving mechanism 5000 and the second Z-axis moving mechanism 5001, the first cutting unit 3000 and the second cutting unit 3001 are moved in the −Z direction, so that the cutting edges 302 of the respective rotating cutting blades 30 are brought into contact with the desired two streets 104 on the workpiece 101 and at the same time the workpiece 101 held on the holding table 2 is moved in the X-axis direction using the X-axis moving mechanism 7. Accordingly, the workpiece 101 and the cutting blades 30 are moved relative to each other in the X-axis direction so that the workpiece 101 is cut along the desired two streets 104.

After performing the cutting along the desired two streets 104, the first cutting unit 3000 and the second cutting unit 3001 are moved, for example, by the interval between the adjacent streets 104 in the Y-axis direction using the first Y-axis moving mechanism 4000 and the second Y-axis moving mechanism 4001, and the cutting blades 30 are similarly brought into cutting engagement with the next two streets 104 adjacent the desired two streets 104, thereby enabling to perform cutting processing along the next two streets 104.

By performing similar cutting processing after cutting the workpiece 101 along all the streets 104 formed on the workpiece 101 and extending in the same direction as described above and then rotating the holding table 2, for example, over 90 degrees using, for example, an undepicted rotation mechanism or the like, cutting processing can be applied along all the streets 104 on the workpiece 101.

By performing the cutting of the workpiece 101 with the shape of the support surface 6311 corrected in the desired arc shape in cross-section, the cutting edges 302 of the cutting blades 30 do not wobble in the Y-axis direction, thereby enabling to prevent widening of cut grooves (kerfs).

2. Second Embodiment

Figure 8:
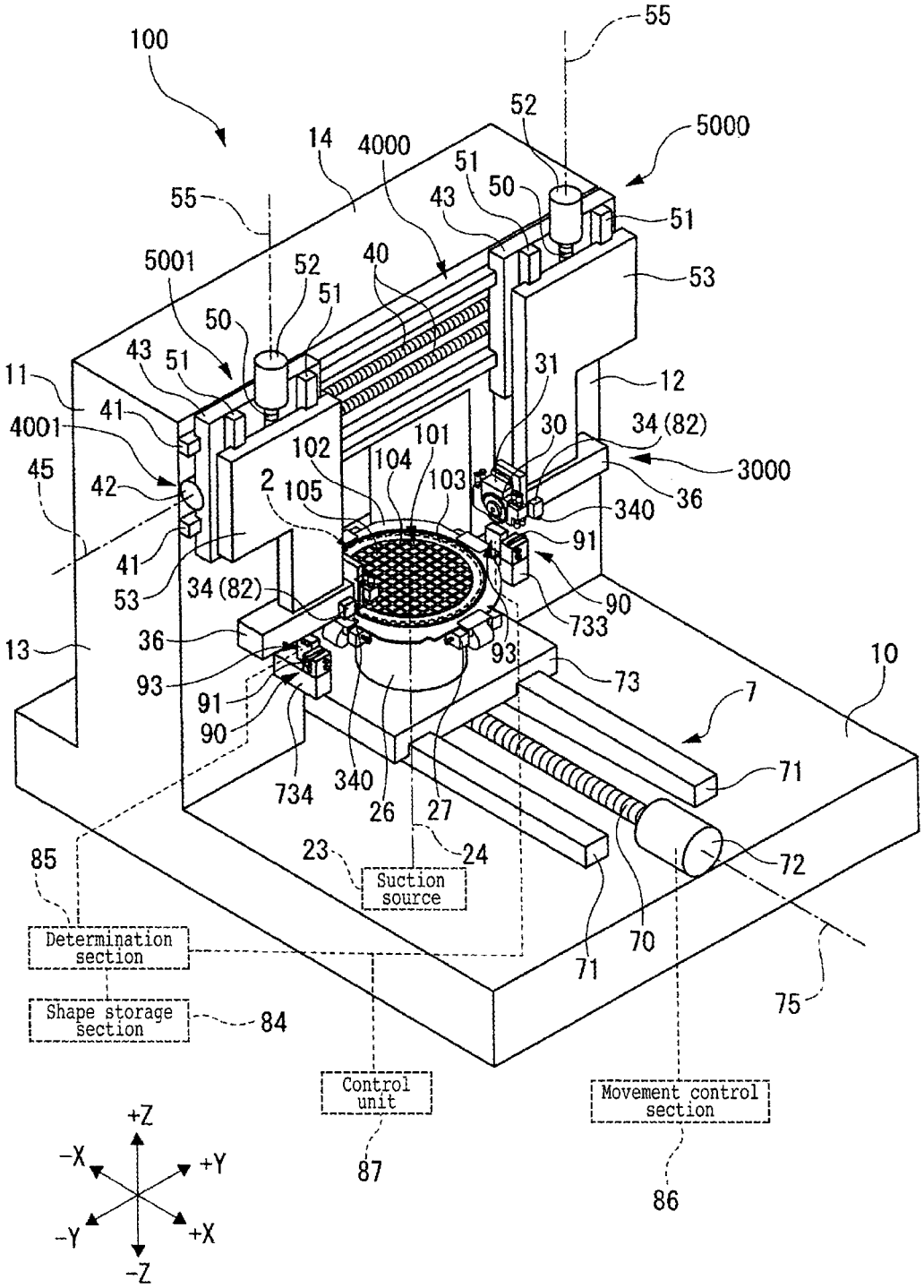
FIG. 8 is a perspective view depicting a cutting machine according to a second embodiment of the present invention.

A cutting machine 100 according to the second embodiment depicted in FIG. 8 adopts a first base 733 and a second base 734, end face correction devices (end face correction means) 90 and shape measurement units (shape measurement means) 93 in place of the first base 731 and the second base 732, the end face correction devices 80 and the shape measurement units 83, all of which are depicted in FIG. 1, and the remaining constituents are configured as in the cutting machine 1 depicted in FIG. 1. The constituents configured as in the cutting machine 1 are identified by like reference symbols as in FIG. 1, and their description is omitted.

The first base 733 is fixed on the first column portion 12, while the second base 734 is fixed on the second column portion 13.

The end face correction devices 90 are arranged on +X sides on upper parts of the first base 733 and the second base 734. The correction grinding stones 91 included in the end face correction devices 90 are similar to the correction grinding stones 81 depicted in FIG. 1 in that they stick out from a side surface in a +Y direction of the first base 733 and a side surface in a −Y direction of the second base 734, respectively, toward sides closer to the corresponding mounts 63. However, the correction grinding stones 91 are different in direction, and those formed in a flat plate shape are disposed upright.

Figure 9:
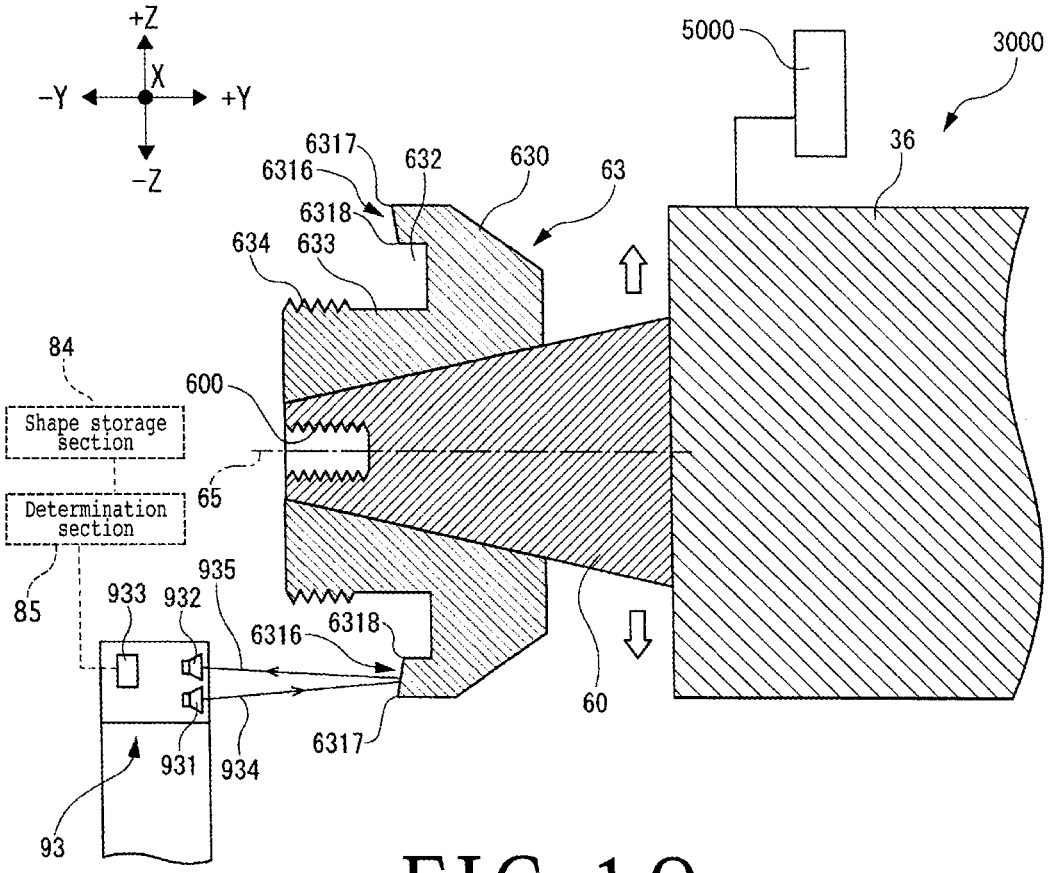
FIG. 9 is a schematic diagram illustrating how to measure a cross-sectional shape, which is similar to that depicted in FIG. 5, of a support surface in the cutting machine according to the second embodiment.

The shape measurement units 93 are arranged at −X side, adjacent positions of the end face correction devices 90 on the first base 733 and the second base 734, respectively. As illustrated in FIG. 9, each shape measurement unit 93 includes a transmitter unit (ultrasonic transmitter, ultrasonic oscillator) 931 that transmits ultrasonic vibrations 934 toward the support surface 6316 in the axial direction of the spindle 60, a receiver unit (ultrasonic receiver, ultrasonic sensor) 932 that receives reflected ultrasonic vibrations 935 of the ultrasonic vibrations 934 transmitted from the transmitter unit 931 and reflected on the support surface 6316, and a calculation unit 933 that calculates a time from the transmission of the ultrasonic vibrations by the transmitter unit 931 until the reception by the receiver unit 932 of the vibrations reflected on the support surface 6316 and based on the time, calculates a distance from the transmitter unit 931 to the support surface 6316.

A description will be made regarding a correction of the shape of the support surface 6316 in the case that the support surface 6316 of the mount 63 has a flared shape in cross-section as illustrated in FIG. 9.

When replacing the cutting blade 306 depicted in FIG. 5, the cutting blade 306 is detached from the mount 63. Similar to the cutting machine 1 depicted in FIG. 1, the shape measurement unit 93 measures the shape of the support surface 6316 of the mount 63. Described specifically, as illustrated in FIG. 9, while rotating the mount 63 about the rotation axis 65 of the spindle 60 and moving the first cutting unit 3000 up and down by the first Z-axis moving mechanism 5000, the transmitter unit 931 transmits the ultrasonic vibrations 934 toward the support surface 6316 in the axial direction of the spindle 60, the receiver unit 932 receives the reflected ultrasonic vibrations 935 reflected on the support surface 6316, and the calculation unit 933 calculates the time from the emission of the ultrasonic vibrations 934 from the transmitter unit 931 until the reception by the receiver unit 932 of the reflected ultrasonic vibrations 935 reflected on the support surface 6316. Based on the values of time calculated at individual points on the support surface 6316 as scanned by the ultrasonic vibrations 934 in a similar manner as the scanning of the support surface 6311 by the laser beam in the first embodiment, the calculation unit 933 determines a measured cross-sectional shape, and through a comparison between the stored cross-sectional shape stored in the shape storage section 84 and the measured cross-sectional shape measured by the shape measurement unit 93, the determination section 85 determines whether the shape of the support surface 6316 needs a correction. If determined to need, the shape of the support surface 6316 is corrected as will be described hereinafter.

Figure 10:
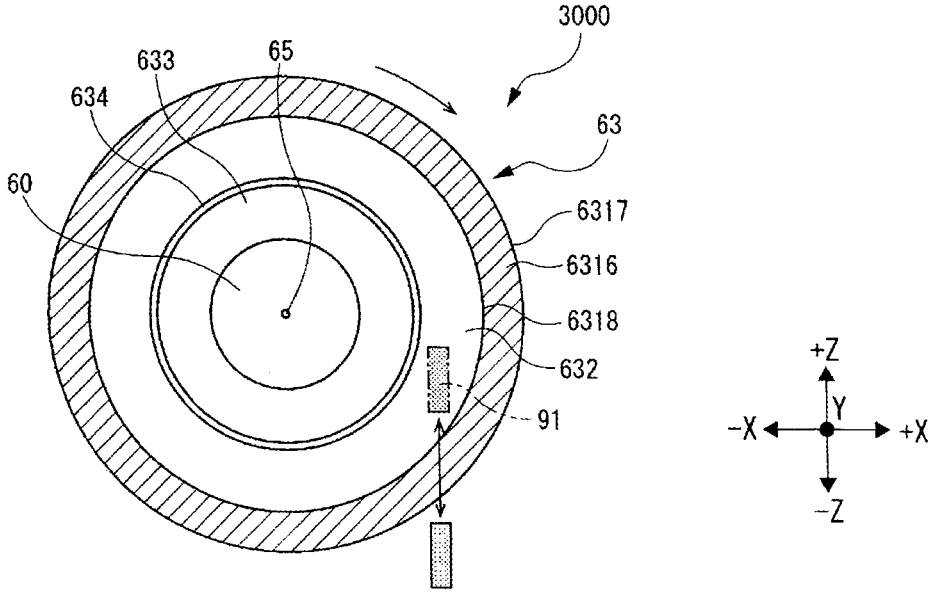
FIG. 10 is a schematic view illustrating how to correct the cross-sectional shape of the support surface in the cutting machine according to the second embodiment.

When correcting the cross-sectional shape of the support surface 6316, the movement control section 86 controls the first Z-axis moving mechanism 5000 to move the first cutting unit 3000 in a Z-axis direction, and also controls the X-axis moving mechanism 7 to move the movable plate 73 in an X-axis direction, whereby as illustrated in FIG. 10, the correction grinding stone 91 is positioned, for example, inside the support surface 6316.

Next, the first cutting unit 3000 is moved in a Y-axis direction, and is positioned at a location where the support surface 6316 of the mount 63 and a +Y side end of the correction grinding stone 91 can come to contact with each other. For example, the distance between the position in the Y-axis direction of the camera 340 and the position in the Y-axis direction of a most protuberant portion 6317 of the support surface 6316 of the mount 63, the most protuberant portion 6317 protruding most in the −Y direction, is available to the control unit 87, and the position in the Y-axis direction of the most protuberant portion 6317 of the support surface 6316 and the position of the +Y side end of the correction grinding stone 91 are allowed to match each other by positioning the first cutting unit 3000 at a location corresponding to a difference obtained by subtracting the above-described distance from the position of the first cutting unit 3000 when the center of the lens of the camera 340 is located at the +Y side end of the correction grinding stone 91.

With the support surface 6316 being hence set ready to be subjected to processing by the correction grinding stone 91, the mount 63 is rotated about the rotation axis 65 of the spindle 60, and at the same time the first cutting unit 3000 is raised in a +Z direction by the first Z-axis moving mechanism 5000, whereby the correction grinding stone 91 is brought into contact with an inner peripheral edge 6318 of the support surface 6316 and processing of the support surface 6316 is started.

After the first Z-axis moving mechanism 5000 has raised the first cutting unit 3000 in the +Z direction, the first Y-axis moving mechanism 4000 is controlled to move the first cutting unit 3000 in the +Y direction so that the +Y side end of the correction grinding stone 91 remains out of contact with the support surface 6316. The first cutting unit 3000 is next lowered in the −Z direction to position the correction grinding stone 91 inside the support surface 6316. Next, the first Y-axis moving mechanism 4000 moves the first cutting unit 3000 in a predetermined amount in the −Y direction by index feeding so that the support surface 6316 is enabled to contact the +Y side end of the correction grinding stone 91. By repeating such a movement over and over, the stock removal of the support surface 6316 is large at the beginning of contact of the correction grinding stone 91 with the support surface 6316 and then becomes gradually smaller due to wearing of the correction grinding stone 91. Using this phenomenon, the support surface 6316 is therefore formed in a flared shape in cross-section.

The correction of the support surface 6316 may be performed using the correction grinding stone 81 in the first embodiment described above.

After correcting the shape of the support surface 6316 as described above, the shape measurement unit 83 is positioned to face the support surface 6316 and the shape of the corrected support surface 6316 is ascertained by the shape measurement unit 83. The method of this ascertainment is similar to that used before the correction of the shape of the support surface 6316.

The determination section 85 then compares the measured cross-sectional shape of the support surface 6316 as ascertained by the shape measurement unit 83 and the stored cross-sectional shape stored in the shape storage section 84 and, if different, the correction of the support surface 6316 is performed again. If the measured cross-sectional shape and the stored cross-sectional shape are determined to match each other, on the other hand, the hubless blade 306 is fitted as a cutting blade on the mount 63, and the nut 66 is brought into threaded engagement with the external thread 634 of the mount 63. In this state, as depicted in FIG. 5, one side in the +Y direction of the hubless blade 306 is supported in a cross-sectional shape, which flares in the +Y direction on a radially inner side thereof, on the most protuberant portion 6317 of the support surface 6316.

In each of the first and second embodiments described above, the description is made regarding the case in which the shape of the support surface 6311 or 6316 of the mount 63 of the cutting unit 3000 is corrected. A similar correction method is applied to a correction of the shape of the support surface 631 of the mount 63 of the second cutting unit 3001, although the directions of the end face correction device 90, the shape measurement unit 93, and the mount 63 merely become opposite.

In each of the first and second embodiments described above, the cutting machine 1 is configured that the end face correction devices 80 or 90 and the shape measurement units 83 or 93 are fixed and the first cutting unit 3000 and the second cutting unit 3001 are movable. However, the end face correction devices 80 or 90 and the shape measurement units 83 or 93 may be configured to be movable. In each of the first and second embodiments described above, the description is made regarding the cutting machine 1 having the two cutting units 3000 and 3001. However, the cutting machine 1 may include only one of the cutting units 3000 and 3001.

The present invention is not limited to the details of the above described preferred embodiments. The scope of the invention is defined by the appended claims and all changes and modifications as fall within the equivalence of the scope of the claims are therefore to be embraced by the invention.

What is claimed is:

1. A cutting machine for cutting a wafer using a cutting blade, comprising:

a holding table that holds the wafer on a holding surface thereof;

a cutting unit including a mount having an external thread formed on a distal end of a cylinder, the external thread being disposed on a distal end of a spindle and extending in an axial direction of the spindle, and a support surface that is formed in an annular shape concentric with the external thread and supports the cutting blade thereon, and a nut that is brought into threaded engagement with the external thread to hold the cutting blade between the nut and the support surface, whereby the wafer held on the holding surface is cut by the cutting blade;

a shape storage section that stores a cross-sectional shape of the support surface in the axial direction of the spindle;

a shape measurement unit that contactlessly measures the cross-sectional shape of the support surface in the axial direction of the spindle;

a determination section that through a comparison between the cross-sectional shape stored in the shape storage section and the cross-sectional shape measured by the shape measurement unit, determines whether or not the support surface needs a correction; and an end face correction device that corrects a shape of the support surface, wherein the end face correction device includes a correction grinding stone arranged such that the correction grinding stone is able to be brought into contact with the support surface, an end detection section that detects an end of the correction grinding stone, and a movement control section configured to move the correction grinding stone and the support surface relative to each other in a direction parallel to the support surface with the end of the correction grinding stone maintained in contact with the support surface.

2. The cutting machine according to claim 1, wherein the shape measurement unit includes an emitter unit that emits a laser beam toward the support surface in the axial direction of the spindle, and an image sensor that receives reflected light of the laser beam reflected on the support surface, and the shape measurement unit measures a distance from the emitter unit to the support surface in the axial direction of the spindle based on a light reception position at which the image sensor has received the reflected light.

3. The cutting machine according to claim 1, wherein the shape measurement unit includes a transmitter unit that transmits ultrasonic vibrations toward the support surface in the axial direction of the spindle, and a receiver unit that receives vibrations generated by reflection of the ultrasonic vibrations on the support surface, the ultrasonic vibrations being transmitted by the transmitter unit, and the shape measurement unit measures a distance from the transmitter unit to the support surface in the axial direction of the spindle based on a time from the transmission of the ultrasonic vibrations by the transmitter unit until the reception by the receiver unit of the vibrations reflected on the support surface.

* * * * *